US006519856B1

(12) United States Patent
Dischler

(10) Patent No.: US 6,519,856 B1
(45) **Date of Patent: *Feb. 18, 2003**

(54) SAFETY RAZOR HEAD WITH INTRINSIC FENCING AND LATERAL SKIN TENSIONING

(75) Inventor: Louis Dischler, Spartanburg, SC (US)

(73) Assignee: Delphi Oracle Corp, Spartanburg, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/467,406

(22) Filed: Dec. 20, 1999

Related U.S. Application Data

(63) Continuation-in-part of application No. 09/164,837, filed on Oct. 1, 1998, now Pat. No. 6,035,535, and a continuation-in-part of application No. 09/102,138, filed on Jun. 22, 1998, now Pat. No. 6,032,372.

(51) Int. Cl.[7] ..... B26B 21/56
(52) U.S. Cl. ..... 30/48; 30/346.57
(58) Field of Search ..... 30/526–532, 49, 30/50, 48, 346.57, 346.56, 346.55

(56) References Cited

U.S. PATENT DOCUMENTS

| | | | | |
|---|---|---|---|---|
| 228,829 | A | | 6/1880 | Moody |
| 1,035,548 | A | | 8/1912 | Dickenson |
| 1,241,921 | A | | 10/1917 | Carroll |
| 1,387,465 | A | | 8/1921 | Browning |
| 1,651,917 | A | | 12/1927 | Connolly |
| 2,043,998 | A | | 6/1936 | Hadjopoulos |
| 2,766,521 | A | | 10/1956 | Benvenuti |
| 3,138,865 | A | | 6/1964 | Meyer |
| 3,263,330 | A | | 8/1966 | Ferrara |
| 3,505,734 | A | | 4/1970 | Iten |
| 3,750,285 | A | | 8/1973 | Michelson |
| 3,909,939 | A | | 10/1975 | Dootson |
| 3,964,160 | A | | 6/1976 | Gordon |
| 4,247,982 | A | | 2/1981 | Booth et al. |
| 4,252,837 | A | | 2/1981 | Auton |
| 4,663,843 | A | | 5/1987 | Savage |
| 4,914,817 | A | | 4/1990 | Galligan et al. |
| 5,526,568 | A | | 6/1996 | Copeland |
| 5,546,660 | A | | 8/1996 | Burout |
| 5,689,883 | A | | 11/1997 | Oritiz |
| 6,032,372 | A | * | 3/2000 | Dischler ..... 30/346.55 X |

OTHER PUBLICATIONS

U.S. patent application Ser. No. 09/102,138, Dischler, filed Jun. 22, 1998.
U.S. patent application Ser. No. 09/164,837, Dischler, filed Oct. 1, 1998.
U.S. patent application Ser. No. 09/405,764, Dischler, filed Aug. 27, 1999.

* cited by examiner

*Primary Examiner*—Douglas D. Watts

(57) ABSTRACT

The various embodiments of the invention are directed to safety razor heads (120) having intrinsically fenced cutting blades (136, 138) oriented at a high slicing angle to the shaving direction. The razor comprises a plurality of short cutting edges (4) in a spaced relationship across the width of the cutting zone, bounded by leading (112) and trailing guards (104), and oriented at an angle greater than 30 degrees, resulting in enhanced cutting action, improved lubricant and debris flow, and longer life of the cutting edges. Lateral skin tensioning is achieved in one embodiment by the spreading action of left and right oriented cutting edges.

20 Claims, 3 Drawing Sheets

SAFETY RAZOR HEAD WITH INTRINSIC FENCING AND LATERAL SKIN TENSIONING

This application is a continuation-in-part of U.S. application Ser. No. 09/102,138, entitled "Intrinsically Fenced Safety Razor Head", filed in the U.S. Patent and Trademark Office on Jun. 22, 1998, now U.S. Pat. No. 6,032,372, and is a continuation-in-part of U.S. application Ser. No. 09/164,837, entitled "Flexible Safety Razor Head with Intrinsically Fenced Cantilevered Cutting Edges", filed in the U.S. Patent and Trademark Office on Oct. 1, 1998, now U.S. Pat. No. 6,035,535, and is related to co-pending U.S. application Ser. No. 09/405,764, filed on Aug. 27, 1999, entitled "Method for Manufacture of a Razor Head". All cited applications/patents are incorporated by reference in their entirety for all purposes.

FIELD OF THE INVENTION

This invention relates to safety razors of the type that have a plurality of adjacently mounted blades permanently mounted in the razor head. More particularly, this invention relates to razor heads having a plurality of short blades having intrinsic fencing and lateral skin tensioning, mounted at a high slicing angle.

BACKGROUND OF THE INVENTION

The advantages of using blades with a slicing rather than chopping motion have been known for hundreds, perhaps thousands of years. One has but to cut a loaf of bread to immediately realize that a slicing motion cuts cleaner and with less tearing. The most immediate advantage for the blade is the reduction of force that is required for cutting, reducing wear and tear on the cutting blade. For a shaver, it is perhaps more important that the cutting force applied to the follicles be reduced, producing a less painful shaving experience. While it has been possible for the shaver to use straight razors, as well as disposable razor cartridges, in such a way as to create an oblique or slicing angle, this has always been hazardous, as the blade that easily slices follicles also easily slices the epidermis. Several patents have resulted from attempts to safely apply the advantages of a slicing angle to shaving. Gordon, (U.S. Pat. No. 3,964,160) and Copelan, (U.S. Pat. No. 5,526,568) patented razors which made manual oblique shaving easier, that is, the wrist did not have to be held at an awkward angle to maintain the slicing angle, but both lacked the concomitant stability of a razor head perpendicularly oriented to the shaving direction. Copeland teaches that, to obtain the advantages of oblique shaving while avoiding cutting of the skin, the oblique angle of a useable razor head should be restricted to between 10 and 26 degrees, and preferably to an angle of 18 degrees. Razors featuring adjustable slicing angles, such as Gordon's, have had an additional disadvantage, since the geometry of the razor head must be carefully balanced, and is unlikely to be optimum for variable slicing angles. Others have patented a variety of oblique arrangements, wherein a pair of blades are oriented in a "V" arrangement. Carroll (U.S. Pat. No. 1,241,921), Moody (U.S. Pat. No. 228,829), and Browning (U.S. Pat. No. 1,387,465) are typical of this approach, which suffers from excess stability. Because of the large footprint created by the two legs of the cutting zone, such a razor head has great difficulty in handling variations in facial geometry; a difficulty which only increases as the slicing angle, is increased. Savage (U.S. Pat. No. 4,663,843) patented a razor head using a conventional blade in tandem with blades angled at a slicing angle. He teaches that the slicing angle should lie between 15 and 30 degrees, in order to have some of the advantages of oblique cutting, while avoiding cutting of the skin. Savage does not appreciate the advantages arising from the use of intrinsic fencing, which would not only allow shaving at much higher slicing angles, but also make a tandem conventional blade unnecessary. Hadjopoulos (U.S. Pat. No. 2,043,998) patented a razor with a serrated edge. This razor suffers from a number of deficiencies. First, the continuity of the cutting edge is broken by the finger guards, resulting in an incomplete shave; second, the shaving angle must be zero if all of the cutting edges are to contact the skin; and third, in moving the razor in the trim direction, the blades are shadowed by the cap, preventing a clean trim line from being produced. It can also be expected that skin flow control would be poor, as thin skin would tend to bunch between the facing edges of each serration, resulting in an uneven shave, as well as cutting of the epidermis. The patent art is crowded with examples of razors that attempt to employ angled cutting edges, but until now, none have appreciated the combination of characteristics necessary for taking full advantage of a high slicing angle.

Tensioning of the skin in order to control the flow of skin under the cutting edge is an important consideration. Tensioning is often accomplished by providing grooves built into the leading guard, in order to stretch the skin prior to contact with the cutting edges, as taught in U.S. Pat. No. 4,247,982 to Booth, et al. In U.S. Pat. No. 3,909,939, Dootson teaches alternating slanted grooves in the leading guard. Similarly, in U.S. Pat. No. 3,138,865, Meyer claims a safety razor having skin stretching means comprising triangular serrations in the leading guard. These serrations may be flexible, as in U.S. Pat. No. 5,689,883, to Oritiz, and may also be employed in side guards as in U.S. Pat. No. 5,546,660, to Burout. Another means of tensioning the skin prior to the cutting edges comprised rollers as in U.S. Pat. No. 2,766,521 to Benvenuti, and as in U.S. Pat. No. 1,651,917, to Connolly. All of these tensioning means work outside of the cutting zone. It is preferable however, to tension the skin closely as possible to the cutting zone, and it would be most preferable to tension the skin within the cutting zone itself, and to provide for lateral tensioning.

Fencing of razor blades is known. Dickenson, in U.S. Pat. No. 1,035,548, teaches the use of wire wrapping of the blade edges, an approach that has been used by several others, such as Iten, in U.S. Pat. No. 3,505,734, and Michelson, in U.S. Pat. No. 3,750,285. Similarly, Ferrara, in U.S. Pat. No. 3,263,330, discloses a fencing arrangement wherein the blade edge is wrapped with a flexible perforated sheet, and Auton, in U.S. Pat. No. 4,252,837, claims a blade fenced with a vacuum deposited intermittent coating. Galligan et al., in U.S. Pat. No. 4,914,817, teaches the use of tape having parallel riblets covering parts of the blade edges. None have previously appreciated the advantages accruing from intrinsically fenced blades. All the United States patents cited in the Specification are hereby fully incorporated by reference.

OBJECTS AND ADVANTAGES

Accordingly, I claim the following as objects and advantages of the invention: to provide a razor head having intrinsically fenced cutting means oriented at a high shearing angle which is capable of producing a smooth, safe shave with reduced pulling of follicles, to enhance the life of razor cutting means, to provide a clean trim line, to provide bi-directional skin tensioning within the cutting zone, to provide cutting edges with varying shaving and slicing angles, to provide channels for improved flow of shaving debris, and to provide improved interaction of shaving lubricant with the cutting edges.

Further objects and advantages will become readily apparent as the specification proceeds to describe the invention with reference to the accompanying drawings.

BRIEF DESCRIPTION OF THE DRAWINGS

The above as well as other objects of the invention will become more apparent from the following detailed description of the preferred embodiment of the invention, when taken together with the accompanying drawings in which.

DRAWING REFERENCE NUMERALS

Figure 1:
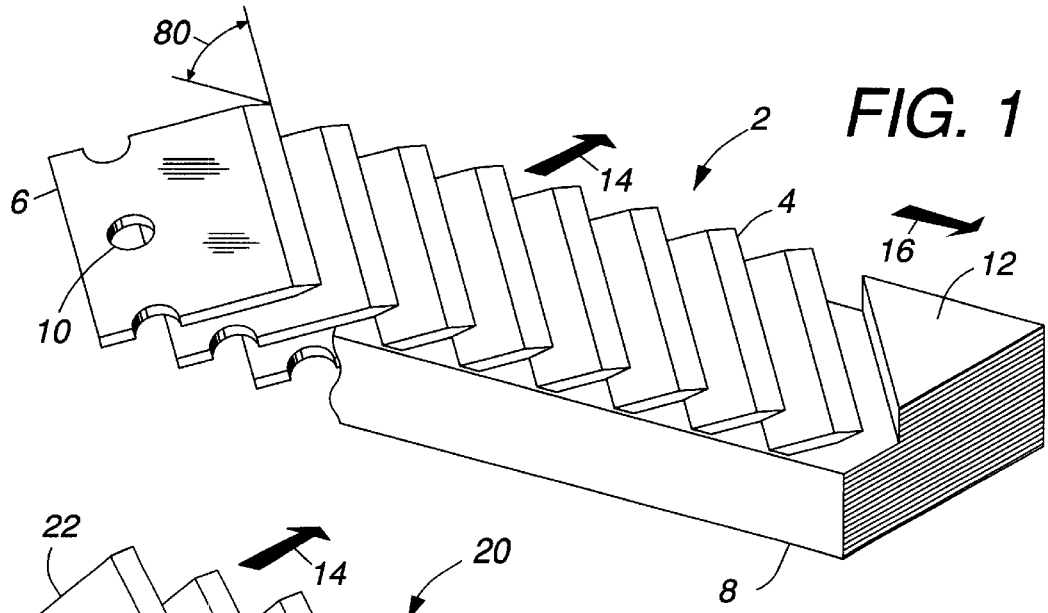
FIG. 1 is a partial perspective view of a composite unitary blade, according to the invention.

| | | | |
|---|---|---|---|
| 2 | composite unitary blade | 70 | leading shaving angle |
| 4 | cutting edge | 72 | trailing shaving angle |
| 6 | blade | 80 | slicing angle |
| 8 | base | 82 | lead slicing angle |
| 10 | perforation | 84 | trailing slicing angle |
| 12 | guard wedge | 90 | razor head |
| 14 | shaving direction | 92 | right flanking guard |
| 16 | trim direction | 94 | right locating post |
| 17 | right trim direction | 98 | individual blade |
| 18 | handle | 100 | blade slot |
| 19 | left trim direction | 102 | cap |
| 20 | composite unitary blade | 104 | trailing guard |
| 22 | blades | 106 | left locating post |
| 24 | blade support | 108 | left flanking guard |
| 26 | blade support | 110 | blade platform |
| 30 | upper leg | 112 | leading guard |
| 32 | lower leg | 114 | skin tensioning means |
| 40 | shaving angle | 120 | razor head |
| 42 | leg angle | 122 | blade platform |
| 52 | blade support | 130 | right unitary blade |
| 54 | lower leg | 132 | lett unitary blade |
| 56 | upper leg | 134 | passageway |
| 60 | flat blade | 136 | blades |
| 62 | twisted blade | 138 | blades |
| 64 | bent blade | 140 | acute shaving angle |
| 66 | blade | 142 | oblique shaving angle |

DETAILED DESCRIPTION OF THE INVENTION

Specific terms are used as follows: "Shaving plane" means the ideally flat skin surface to be shaved. "Safety razor" means a razor having a leading guard, which is typically used with a lather or cream. "Razor head" is meant to include both razor cartridges adapted for use with a separate handle, as well as the upper, operative elements of a disposable razor with a permanently attached handle. "Shaving direction" signifies the primary direction in the shaving plane in which the razor head is intended to be moved. "Trim direction" signifies the direction in the shaving plane generally perpendicular to the shaving direction, that is, the direction taken when the razor head is moved sideways. Left and right sides of the shaving head lie in the trim direction, and are established by facing in the shaving direction. "Cutting zone" refers to that area of the razor head containing blades, which is designed to cut follicles. The cutting zone has a width, which is generally perpendicular to the shaving direction, and a height considerably shorter than the width. "Span" means the distance between two adjacent edges in the cutting zone, measured in the shaving direction. "Leading span" means the span between the leading guard and the first encountered blade edge. "Trailing span" means the span between the trailing guard and the immediately preceding blade edge, while "intermediate span" means the span between two adjacent cutting edges. "Blade spacing" refers to the distance between two adjacent cutting edges measured in the direction perpendicular to the shaving direction. "Fencing" refers to any method of intermittently and positively breaking the contact of a blade edge with the skin, so that a long blade edge is effectively broken up into a series of shorter blade edges. "Effective cutting length" means the uninterrupted cutting edge, bounded by guards or fencing elements, which can contact the skin. "Shaving angle" is the acute angle that the blades make relative to the shaving plane. "Slicing angle" is the acute angle in the shaving plane that the blade edges make relative to the associated trim direction. (There may be more than one trim direction and associated slicing angle.) "Trim angle" is the angle in the shaving plane that the blade edges make relative to the shaving direction. "Guard" refers to one of the generally peripheral ridges that control the contact of the razor edges with the skin. "Leading guard" means the guard extending along the width of the cutting zone, which contacts the skin prior to the blades. "Trailing guard" means the guard extending along the width of the cutting zone, which contacts the skin subsequent to the blades, and "flanking guard" means either one of the two guards that keep the skin from contacting the cut edges of the blades along the height of the cutting zone. "Unitary blade" refers to a structure containing a plurality of cutting edges oriented in a fixed spaced relationship.

PRINCIPLE OF THE INVENTION

The genesis of this invention began with the observation that fencing was effective even at high slicing angles, coupled with the realization that short sections of blades, bounded by leading and trailing guards, were functionally superior to single short blade segments between fencing elements.

An investigation was conducted to examine the relationship of slicing angle to perceived roughness, as it was expected that the sensation of roughness, as it reflects the tendency of the cutting edge to grab and release small protrusions on the surface, would provide a measure of the tendency of the blade to cut into the epidermis. A randomly textured rubber surface was used to simulate rough skin. A razor blade edge, oriented at a 90 degree shaving angle in order to eliminate the propensity to cut into the simulated skin, was loaded to simulate a light shaving pressure, and was pulled across the surface at various slicing angles. A measure of the subjective sensation of roughness was then created by force ranking the trial results obtained with a full width blade using slicing angles from 0 to 80 degrees, at 10-degree increments. This ranking runs from 1 to 9, with larger numbers indicating increasing roughness. The results appear in the column for the 39-mm length in the table below. The perceived roughness tended to increase steadily from 0 degrees to 80 degrees, with a small dip occurring at 10 degrees. The effective blade width was then reduced by partially covering the blade edge with thin metal tape. The trial was then repeated as before, this time rating the perceived roughness relative to the 9 level scale developed using the full width (39 mm) blade.

As the effective blade length was incrementally reduced, an unexpected inversion of the trend to increasing roughness was observed to occur at lengths of 8 mm and below, which is contrary to the teachings of others versed in the art. At 8 mm, the inversion occurs at 40 to 50 degrees, and at 6.5 and 4.5 mm, the inversion occurs at 30 degrees. The inversion is more pronounced at 6.5 mm and below, where the perceived roughness plummets to the lowest levels on the scale. Surprisingly, the best results were obtained at angles greater than 50 degrees. To check the effect of the total exposed blade length, another test was run with a blade fenced in 2 places to provide three lengths of exposed blade, each 4.5 mm long, which produced almost identical results to that tabulated for a single 4.5 mm section in the table below, indicating that this discovered effect is not due to a reduction in the total length of the exposed blade.

TABLE

| | Length of exposed blade edge (mm) | | | | | |
|---|---|---|---|---|---|---|
| | 39 | 11 | 9.5 | 8 | 6.5 | 4.5 |
| | Slicing angle (degrees) | | | | | |
| 0 | 3 | 2 | 3 | 2 | 2 | 3 |
| 10 | 1 | 1 | 1 | 1 | 1 | 1 |
| 20 | 2 | 2 | 2 | 2 | 3 | 2 |
| 30 | 4 | 3 | 2 | 2 | 4 | 3 |
| 40 | 5 | 4 | 2 | 3 | 3 | 2 |
| 50 | 6 | 4 | 3 | 3 | 2 | 2 |
| 60 | 7 | 4 | 5 | 2 | 1 | 1 |
| 70 | 8 | 5 | 5 | 2 | 1 | 1 |
| 80 | 9 | 6 | 5 | 2 | 1 | 1 |

Shaving test were performed using a conventional two-blade cartridge razor fenced to provide multiple exposed blade lengths corresponding to the blade lengths used in the Table above. It was found that exposed blade lengths of 9.5 mm and greater tended to cut the skin at slicing angles about 30 degrees. Using an exposed blade length of 8 mm produced a smooth shave at various shearing angles up to 85 degrees, with no noticeable cutting. However, several hours later, some reddening was observed, indicating that cutting of the epidermis did occur. For exposed lengths of 6.5 mm and below, no cutting or delayed skin response was observed at any slicing angle. Pulling of follicles during shaving was noticeably reduced at angles greater than 30 degrees, and this was particularly noticeable at angles greater than 45 degrees. Subsequent tests were performed using nine short blades arranged in a staggered relationship, and guarded with leading and trailing guards. Using blade lengths of 6.5 mm, slicing angle of 45 degrees, and a shaving angle of approximately 25 degrees, it was apparent that the same benefits of enhanced follicle cutting resulted, while at the same time epidermal damage was avoided, as was predicted from the previous tests. This general arrangement of short blades with leading and trailing guards at a high slicing angle is herein referred to as "intrinsic fencing". The "high slicing angle" should be more than 30 degrees, preferably at least 45 degrees and most preferably at least 50 degrees. An advantage of intrinsic fencing is that the range of shaving angles that may be effective is greater, as potential for cutting of the epidermis is much reduced. For individually sharpened blades, a minimum shaving angle is necessary to allow the blade to contact the skin, and also to provide clearance for the presence of adjacent blades, and to provide a channel between blades for the flow of shaving lubricant and debris. For any slicing angle, the shaving angle should be between 2 and 90 degrees, more preferably between 5 and 85 degrees, and most preferably between 10 and 80 degrees. To control the flow of skin so that contact with the blades is limited to the effective blade length, the leading and trailing guards should rise approximately to the level of the cutting edges. The guards may also rise above this level, reducing the effective blade length, and may comprise skin tensioning means. Intrinsic fencing is superior to wire or thread fencing, which can break or become dislodged during use, and can trap or impede shaving debris.

For razor heads employing cutting edges at a slicing angle, skin flow control using short blade segments between leading and trailing guards is superior to that obtained by point fencing of the blades, such as that obtained by forming deposits on the blade edge. With leading and trailing guards, the skin is supported in the blade direction by the several blades, and also in the guard direction, while the skin can bulge further into the spaces between the blades when point fencing is used. It is believed that with blades at a high slicing angle, the bulge of skin is better controlled than with either blades at a low slicing angle or with blades in the normal configuration, i.e., 90 degrees to the shaving direction. This is because the bulge of skin tends not to build up in front of the blades at a high slicing angle to the same degree, especially when there is considerable drag caused by the interaction of the blades with a heavy beard. The bulge of skin, in this case, will tend to move sideways, directed by the component of force developed in the trim direction. Blades at a high slicing angle are believed to be particularly better than a serrated blade at controlling this bulge, as the V of the serrated blade would tend to concentrate the bulge at the base of the V. While the skin control of blades at a high slicing angle are superior at skin flow control, this advantage may be increased by using varying slicing angles. In one embodiment of the instant invention, herein referred to as the "bi-directional trim razor", this may be accomplished by employing cutting edges with a positive slicing angle over one half of the cutting zone so that forces of the cutting edges on the skin tend to drive the skin away from the center of the cutting zone, employing cutting edges with a negative slicing angle over the other half of the cutting zone, so that the skin interacting with these cutting edges is urged in the opposite direction. In this case, one half of the cutting zone is preferably the mirror image of the other half, with the cutting edges sloping back from the centerline of the razor. It should be apparent that the forces generated thereby may be resolved into bi-directional forces in the trim direction, tending to stretch the skin in a direction perpendicular to the direction of shaving, and a drag force, which tends to stretch the skin parallel to the direction of shaving, thereby fully tensioning the skin and limiting the possibility of creasing of the skin in the cutting zone. Also, since these bi-directional forces are generated within the cutting zone itself, spring-back of the skin, which might otherwise occur when the skin is tensioned away from the cutting zone, is not likely to occur.

The arrangement of blades in the instant invention produces a variable span—a leading span which ranges from zero to the intermediate span, which is constant, and a trailing span, which ranges from the intermediate span to zero. To control the intermediate span so as to produce a smooth and continuous shave, the blade spacing should not exceed the effective blade length multiplied by the cosine of the slicing angle. Also, it is believed that the minimum effective blade length is about 1 mm, in order to provide sufficient cutting action. For the cutting edges to efficiently interact with the follicles, and for most effective skin tensioning, the shaving angle should be between 2 and 90 degrees, more preferably between 5 and 85 degrees, and most preferably between 10 and 80 degrees. The individual blades may be twisted helically so that the shaving angle progressively increases or decreases from the leading to the trailing edge of the blade. The helically twisted blade will have a leading shaving angle and a trailing shaving angle, as well as intermediate shaving angles at points between the leading and trailing points of the cutting edges. The blade may also be bent, either permanently, or by compressive mounting forces so that the slicing angle similarly increases or decreases from the leading to trailing edges. Bending and twisting may usefully be combined, so that both slicing angle and shaving angle can be tailored simultaneously along the length of the cutting edge. While it is believed that progressive changes of the shaving and slicing angles may be employed to further modify and improve the flow of skin between the blades, both the twisting and bending of the blades tend to increase the stiffness of the blades, allowing thinner blades to be used for a given maximum allowable deflection due to shaving forces.

In order to produce a clean trim line, the shaver may move the razor head of the instant invention against the skin in the trim direction. If, for instance, the blades are set at a slicing angle of 45 degrees, then the trim angle is also 45 degrees. As the shaving and trim directions are orthogonal, the slicing angle plus the trim angle equal 90 degrees. Trimming a clean line next to a mustache can be accomplished by moving the razor head down the face to the edge of the mustache, then moving the razor head sideways along the edge of the mustache. When moved sideways, the cutting means are arranged one behind the other. This not only produces a sharp trim line, but cuts the follicles many times over in one pass, so as to produce an unusually close shave. The razor head of the instant invention thus has two modes of operation, shaving and trimming, which in general can be accomplished without twisting the razor head or the wrist, but is accomplished simply by changing the direction of the stroke. For a razor with bilateral skin tensioning, trimming may also be accomplished in the forward and reverse trim directions; i.e. the razor has two anti-parallel trim directions, both which are orthogonal to the shaving direction. In one embodiment of the instant invention, strip blades may be bonded into a fixed position using the process of insert injection molding, pultrusion, welding, or by the use of adhesives, to fix the blades into a permanent geometrical relationship. An individual blade insert may be created, or preferably, a billet which is thereafter cut along a diagonal to form a composite unitary blade. It is preferred that the blades are perforated so as to allow them to be mechanically locked in place.

Figure 2:
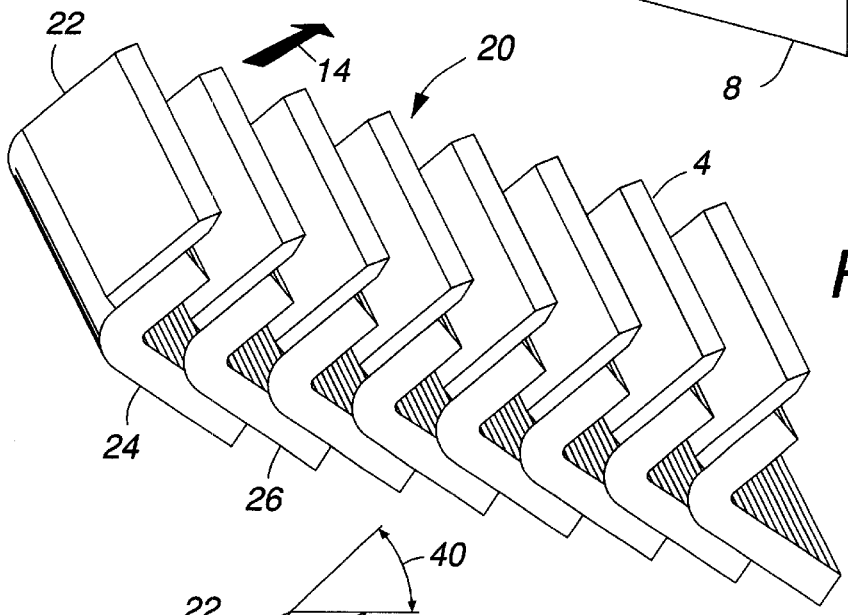
FIG. 2 is a partial perspective view of another composite unitary blade.
Figure 3:
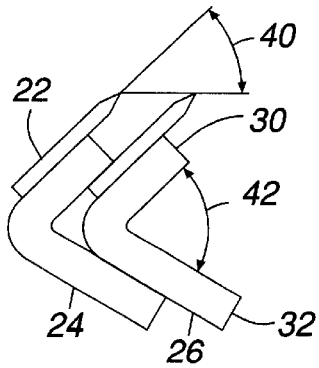
FIG. 3 is a side view of two adjacent blades in FIG. 2.
Figure 4:
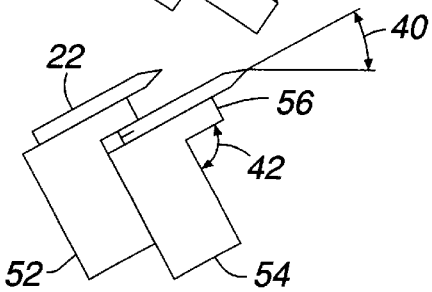
FIG. 4 is a side view of an alternative embodiment of adjacent blades shown in FIG. 3.

Turning now to the drawings, a composite unitary blade 2 is illustrated in FIG. 1, which comprises blades 6 with cutting edges 4, oriented at a slicing angle 80, bonded in a fixed spaced relationship in a base 8 which has a triangular guard wedge 12 to avoid the use of short, difficult to handle blades The blades 6 have perforations 10 in order to aid in mechanically trapping the blades 6 into the base 8. The shaving direction is indicated by arrow 14, and the trim direction by arrow 16. Another embodiment of the composite unitary blades is illustrated in FIG. 2, wherein the composite unitary blade, generally indicated by the numeral 20, comprises blades 22 individually bonded to blade supports 24, which are in turn bonded to adjacent blade supports 26. Bonding may be adhesive, or by means of welding. As shown in FIG. 3 and the shaving angle 40 is related to the thickness of the blade 22, the upper leg 30 and lower leg 32 of the blade support 24, and the leg angle 42. Similarly, in FIG. 4, the shaving angle 40 is related to the thickness of the blade 22, the upper leg 56 and the lower leg 54 of the blade support 52. In this case the thickness of the upper leg 56 is less than that of the lower leg 54, resulting in a flatter shaving angle 40.

Figure 5:
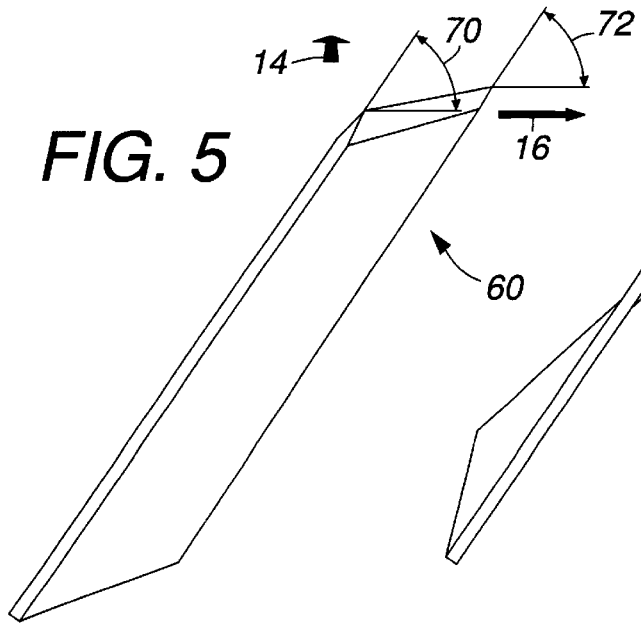
FIG. 5 is a perspective view of a single flat cutting edge, illustrating the various angular relationships, according to the invention.
Figure 6:
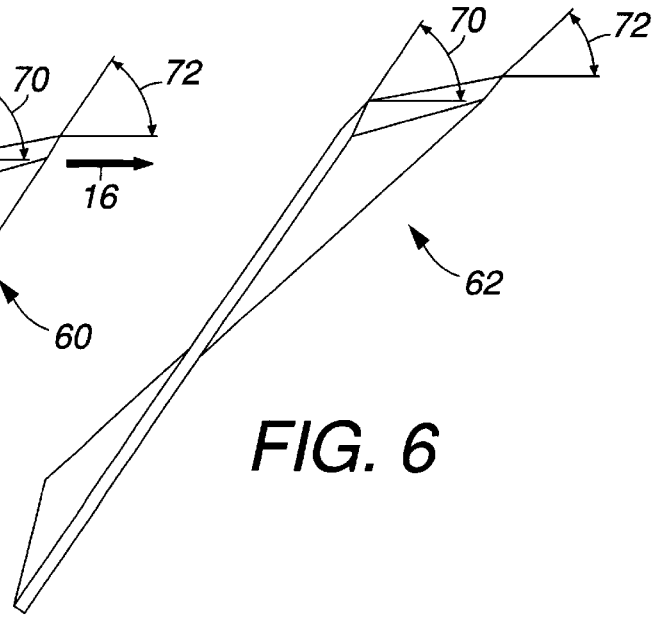
FIG. 6 is a perspective view of a single cutting edge, illustrating the various angular relationships of a helically twisted blade segment, according to the invention.
Figure 7:
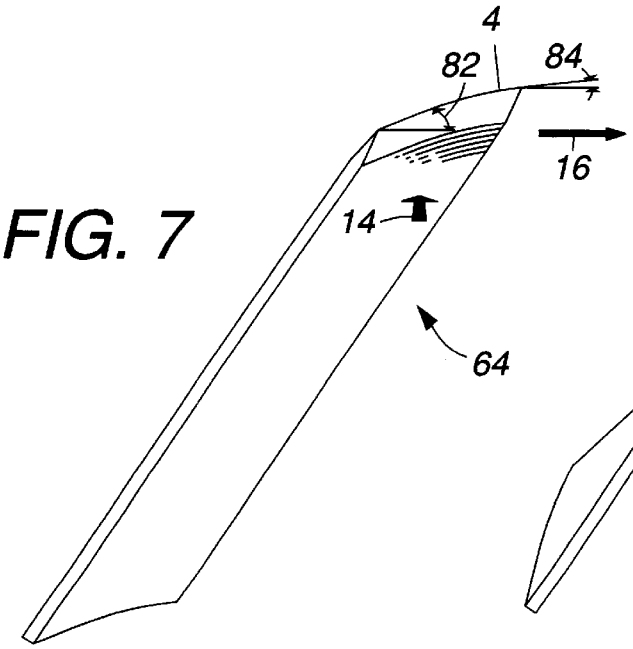
FIG. 7 is a perspective view of a single cutting edge, illustrating the various angular relationships of a curved blade segment, according to the invention.
Figure 8:
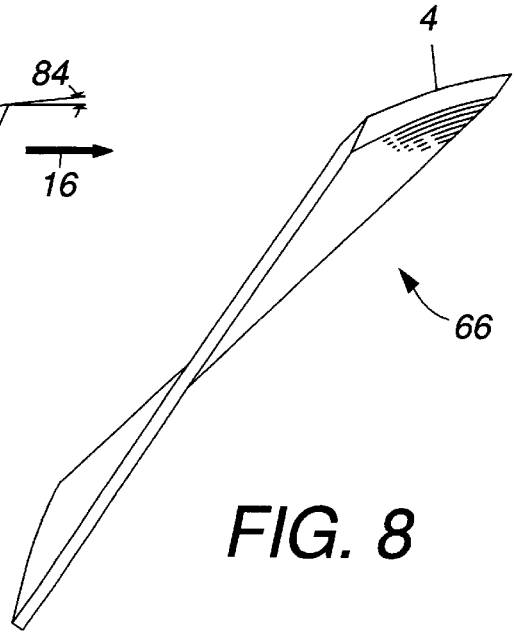
FIG. 8 is a perspective view of a single cutting edge, illustrating a curved and twisted blade segment, according to the invention.

A single flat blade 60 to be used in a linear array is shown in FIG. 5. This blade 60 is planar, with no curvature, so that the leading shaving angle 70 is equal to the trailing shaving angle 72. In another embodiment, as shown in FIG. 6, the blade 62 may be helically twisted along an axis generally parallel to the cutting edge 4. This results in a leading shaving angle 70 which is greater than the trailing shaving angle 72. The blade may be twisted in the opposite sense so that the leading shaving angle 70 is less than the trailing shaving angle 72, if desired. The shaving angle may be thereby varied throughout the shaving stroke, so as to produce the optimum shave, while simultaneously the stiffness of the blade 62 is enhanced. In FIG. 7, a bent blade 64 is shown, which may be achieved by either pre-bending the blade 64, or by installing the blade so that it is placed in compression. While the shaving angle does not substantially vary along the length of the blade 64, the lead slicing angle 82 is greater than the trailing slicing angle 84. The blade cutting edge 4 bulges slightly out of the cutting plane towards the skin, and the stiffness of the blade is enhance by the curvature. Both the shaving and slicing angles may be simultaneously varied, as in shown in FIG. 8, so that the stiffness of the blade 66 is thereby enhanced and the shaving parameters are optimized as the cutting edges progress across the skin surface in either the shaving or trim directions.

Figure 9:
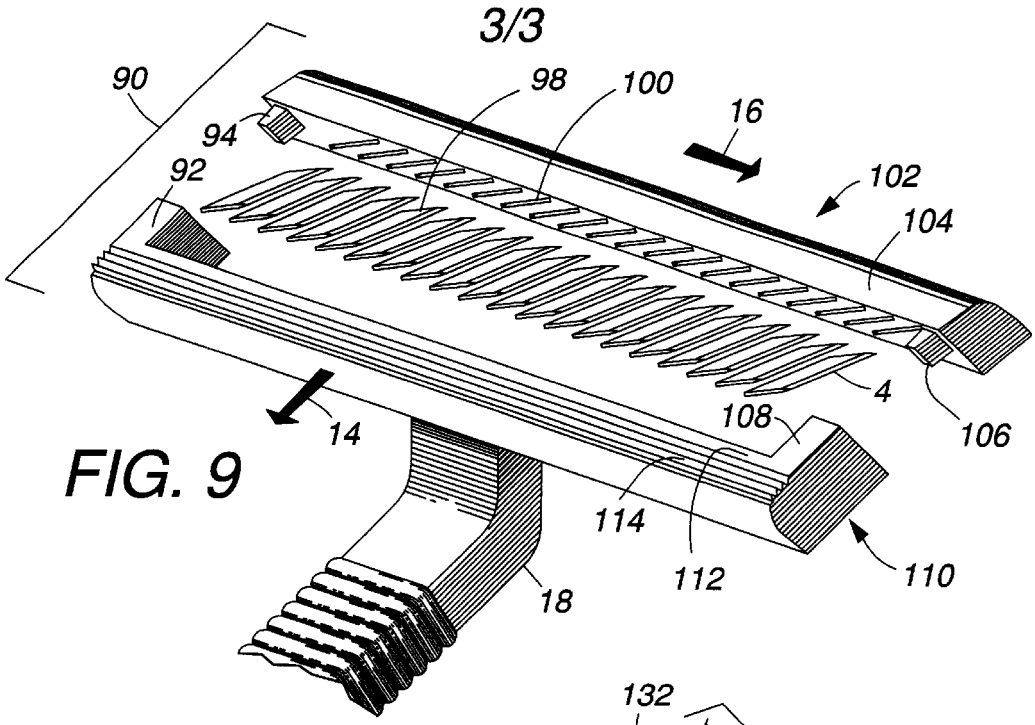
FIG. 9 is an exploded perspective view of a razor head of one embodiment of the invention.

An embodiment of the invention wherein the cutting means are assembled is illustrated in FIG. 9, where the exploded razor head is generally indicated by the numeral 90, mounted to handle 18. The shaving direction is indicated by arrow 14, and the single trim direction by arrow 16. The razor head 90 is shown to comprise a blade platform generally indicated by the numeral 110, a plurality of individual blades 98, and a cap 102. The cap 102 comprises left and right locating posts 106, 94 which enter into matching receiving notches (not shown) in the blade platform 110. The cap 102 has a trailing guard 104, which rises slightly above the cutting edges 4 of the individual blades 98 when assembled. Blade slots 100 in the cap 102, in cooperation with blade slots (not shown) in the platform 110, capture and support the blades 98 therebetween when the cap 102 and platform 110 are mated. This construction allows free passage of shaving debris between adjacent blades 98, exiting from the rear of the razor head 90. The blade platform 110 further comprises a leading guard 112 rising slightly above the level of the cutting edges 4 of the blades 98 when assembled, and having skin tensioning means 114, a left flanking guard 108, and a right flanking guard 92. While skin tensioning means 114 have been illustrated in the several drawings as comprising triangular shaped riblets, any method of skin tensioning may be employed, or tensioning may be achieved entirely by the action of the cutting edges 4 on the skin.

Figure 10:
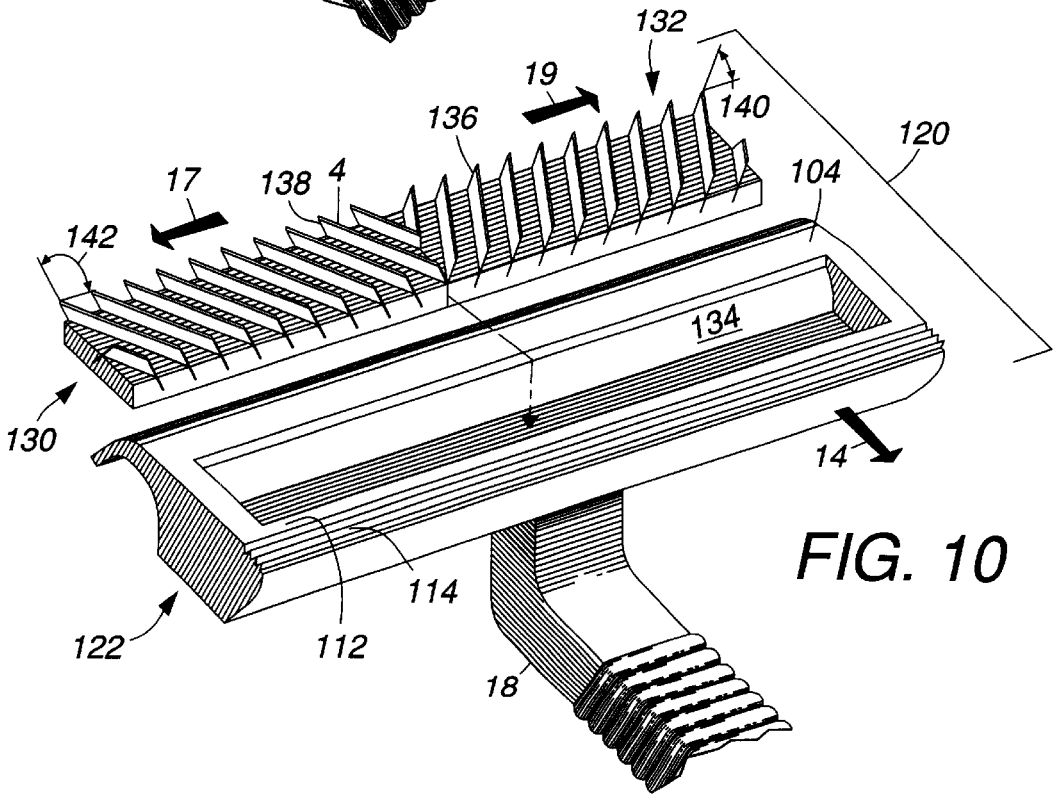
FIG. 10 is an exploded perspective view of a razor head of an embodiment of the invention having lateral skin tensioning.

An embodiment of the invention having bi-directional unitary cutting means is illustrated in FIG. 10, where the exploded razor head is generally indicated by the numeral 120, mounted to handle 18. The shaving direction is indicated by arrow 14, the left trim direction by arrow 19, and the right trim direction by arrow 17. The razor head 120 is shown to comprise a blade platform generally indicated by the numeral 122, a left unitary blade 132, and a right unitary blade 130. Shaving debris are channeled between the blades 136, 138, exiting via the passageway 134 to the back of the razor head 120. The blades 136 of the left unitary blade 132 diverge away from the center line of the razor head 120, urging the skin surface in left trim direction 19 as the razor is pulled in the shaving direction 14. Similarly, the opposite orientation of the blades 138 of the right unitary blade 130, urge the skin surface in the right trim direction 17 as the razor moves in the shaving direction 14. As the razor head 120 is moved in the left trim direction 19, the blades 136 are oriented at an acute shaving angle 140, while the blades 138 of the right unitary blade 130 are oriented at an oblique (non-cutting) shaving angle 142, so that the blades 136 are functionally oriented for cutting while the blades 138 are non-cutting. As the razor 120 is symmetrical, the shaving angles of the blades 136, 138 are reversed when the razor is moved in the right trim direction 17.

While the invention has been described in connection with preferred embodiments, it is not intended to limit the scope of the invention to the particular form set forth, but on the contrary, it is intended to cover such alternatives, modifications, and equivalents as may be included within the spirit and scope of the invention as defined by the appended claims. In the claims, means-plus-function clauses are intended to cover the structures described herein as performing the recited function and not only structural equivalents, but also equivalent structures.

I claim:

1. A safety razor head assembly having a cutting zone having a width, comprising spaced leading and trailing guard means, and a plurality of cutting edges disposed in the space between said leading and trailing guard means, said cutting edges fixed in a spaced relationship along the cutting zone width, each of said cutting edges having a leading edge and a trailing edge and an effective cutting length between said leading edge and said trailing edge, said cutting edge having a slicing angle and a shaving angle, where said effective cutting length is less than about 8 mm, said slicing angle is greater than 30 degrees and less than about 85 degrees, and said shaving angle lies in the range between 2 degrees and 90 degrees.

2. A safety razor head as recited in claim 1, wherein said spaced relationship comprises a blade spacing which is less than said effective cutting length multiplied by the cosine of said slicing angle.

3. A safety razor head as recited in claim 1, wherein said slicing angle is greater than 30 degrees, and said effective cutting length is less than about 6.5 mm.

4. A safety razor head as recited in claim 1, wherein said slicing angle is greater than about 40 degrees, and said effective cutting length is less than about 8 mm.

5. A safety razor head as recited in claim 1, wherein said slicing angle is greater than about 40 degrees, and said effective cutting length is less than about 6.5 mm.

6. A safety razor head as recited in claim 1, wherein said slicing angle is greater than about 50 degrees, and said effective cutting length is less than about 6.5 mm.

7. A safety razor head as recited in claim 1, wherein said slicing angle is about 45 degrees.

8. A safety razor head as recited in claim 1, wherein at least one of said cutting edges is curved.

9. A safety razor head as recited in claim 1, wherein said shaving angle lies in the range between 10 degrees and 85 degrees.

10. A safety razor head as recited in claim 1, wherein said shaving angle lies in the range between 15 degrees and 80 degrees.

11. A safety razor head assembly having a cutting zone having a width, comprising spaced leading and trailing guard means, and a plurality of cutting edges disposed in the space between said leading and trailing guard means, said cutting edges fixed in a spaced relationship along the cutting zone width, each of said cutting edges having a leading edge and a trailing edge and an effective cutting length between said leading edge and said trailing edge, said leading edge of said cutting edge having a leading slicing angle and a leading shaving angle, said trailing edge of said cutting edge having a trailing slicing angle and a trailing shaving angle, where said effective cutting length is less than about 8 mm, said leading slicing angle is greater than 30 degrees and less than about 85 degrees, said leading shaving angle lies in the range between 2 degrees and 90 degrees, said trailing slicing angle is greater than 30 degrees and less than about 85 degrees, and said trailing shaving angle lies in the range between 2 and 90 degrees.

12. A safety razor head as recited in claim 11, wherein said leading slicing angle is different from said trailing slicing angle.

13. A safety razor head as recited in claim 11, wherein said leading shaving angle is different from said trailing shaving angle.

14. A safety razor head as recited in claim 11, wherein said cutting edges are curved.

15. A safety razor head having a cutting zone having a width, comprising:

a leading guard;

a trailing guard behind said leading guard, forming a space therebetween;

a first plurality of cutting edges disposed in said space between said leading guard and said trailing guard;

said first plurality of cutting edges fixed in a spaced relationship along the cutting zone width, each of said first plurality of cutting edges having a first leading edge, a first trailing edge, and a first effective cutting length between said first leading edge and said first trailing edge, wherein said first effective cutting length is less than about 8 mm;

each of said first plurality of cutting edges having a first slicing angle, wherein said first slicing angle is greater than 30 degrees and less than about 85 degrees; and each of said first plurality of cutting edges having a first shaving angle, wherein said first shaving angle is greater than 2 degrees and less than 90 degrees.

16. A safety razor head as recited in claim 15, wherein at least one of said first plurality of cutting edges is curved so that said first slicing angle transitions into a second slicing angle.

17. A safety razor head as recited in claim 15, wherein said at least one of said first plurality of cutting edges is curved so that said first shaving angle transitions into a second shaving angle.

18. A safety razor head as recited in claim 15, further comprising:

a second plurality of cutting edges disposed in said space between said leading guard and said trailing guard, said second plurality of cutting edges adjacent to said first plurality of cutting edges;

said second plurality of cutting edges fixed in a spaced relationship along the cutting zone width, each of said second plurality of cutting edges having a second leading edge, a second trailing edge, and a second effective cutting length between said second leading edge and said second trailing edge, wherein said second effective cutting length is less than about 8 mm;

each of said second plurality of cutting edges having a second slicing angle, wherein said second slicing angle is greater than 30 degrees and less than about 85 degrees; and each of said second plurality of cutting edges having a second shaving angle, wherein said second shaving angle is greater than 2 degrees and less than 90 degrees.

19. A safety razor head as recited in claim 18, further comprising bilateral skin tensioning means.

20. A safety razor head as recited in claim 19, wherein said bilateral skin tensioning means lies within the cutting zone.

* * * * *